US007507926B2

(12) United States Patent
Kawamura et al.

(10) Patent No.: US 7,507,926 B2
(45) Date of Patent: Mar. 24, 2009

(54) SLIDE SWITCH

(75) Inventors: Takashi Kawamura, Fukuoka (JP); Takahiro Sasaki, Fukuoka (JP); Hidetake Kikuchi, Fukuoka (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 83 days.

(21) Appl. No.: 11/755,348

(22) Filed: May 30, 2007

(65) Prior Publication Data

US 2007/0278084 A1 Dec. 6, 2007

(30) Foreign Application Priority Data

May 31, 2006 (JP) ..... P2006-152668

(51) Int. Cl.
*H01H 15/02* (2006.01)

(52) U.S. Cl. ..... 200/548; 200/549; 200/550; 200/16 C

(58) Field of Classification Search ..... 200/16 R–16 D, 200/547–500, 329
See application file for complete search history.

(56) References Cited

U.S. PATENT DOCUMENTS

| | | | | |
|---|---|---|---|---|
| 4,658,101 | A * | 4/1987 | Akimoto et al. | 200/16 R |
| 4,825,020 | A * | 4/1989 | Rao et al. | 200/16 D |
| 4,841,105 | A * | 6/1989 | Goodman et al. | 200/16 D |
| 6,191,373 | B1 * | 2/2001 | Liao | 200/16 A |
| 6,333,479 | B1 * | 12/2001 | Tai | 200/550 |
| 6,559,400 | B2 * | 5/2003 | Hayashi | 200/550 |
| 6,621,018 | B1 * | 9/2003 | Chen | 200/16 C |
| 6,841,744 | B1 * | 1/2005 | Kodo et al. | 200/16 C |
| 2005/0058308 | A1 | 3/2005 | Chang | |

FOREIGN PATENT DOCUMENTS

| | | |
|---|---|---|
| JP | 58 101315 A | 6/1983 |
| JP | 6-7138 | 1/1994 |

OTHER PUBLICATIONS

European Search Report issued on Sep. 20, 2007, for the related Eurpean application, pp. 1 to 8.

* cited by examiner

*Primary Examiner*—Michael A Friedhofer
(74) *Attorney, Agent, or Firm*—Whitham Curtis Christofferson & Cook, PC

(57) ABSTRACT

A case is defining a chamber. A slider is disposed in the chamber and being movable between a first position and a second position. A first contact member is disposed in the chamber and being movable in conjunction with the slider. A second contact member is disposed in the chamber. An urging member is disposed in the chamber. A projection portion is adapted to be fitted with a first recess portion. When the slider is located in the first position, the first contact member comes in contact with the second contact member and the projection portion is not fitted with the first recess portion. When the slider is in the second position, the first contact member is separated from the second contact member, the projection portion is fitted with the first recess portion, and the urging member urges the slider toward the first position.

13 Claims, 9 Drawing Sheets

FIG. 15

| EMBODIMENT | FRONT SIDE SWITCHING POSITION | | REAR SIDE SWITCHING POSITION | |
|---|---|---|---|---|
| | AUTOMATIC RESTORATION | CLICK FEELING | AUTOMATIC RESTORATION | CLICK FEELING |
| 1 | ○ | ○ | | ○ |
| 2 | ○ | | | ○ |
| 3 | | ○ | ○ | ○ |
| 4 | | ○ | ○ | |
| 5 | ○ | ○ | ○ | ○ |
| 6 | ○ | | ○ | |

SLIDE SWITCH

The disclosure of Japanese Patent Application No. 2006-152668 filed May 31, 2006 including specification, drawings and claims is incorporated herein by reference in its entirety.

BACKGROUND

The present invention relates to a slide switch.

In the slide switch, when the slider is slid, the moving contact member slides with respect to the stationary contact member in conjunction with the slider so that the contact points are switched.

Moreover, there are slide switches having a detent mechanism in which a switching feeling (or a click feeling) is given to the operator when a slider is switched (or example, JP-UM-A-6-7138); slide switches not having the detent mechanism; slide switches having an automatic restoration mechanism in which the slider is automatically repositioned at a neutral position when the slider is pushed in a pushing direction from the neutral position and released; or slide switches not having the automatic restoration mechanism. In the related art, however, there is no slide switch which has both the detent mechanism and the automatic restoration mechanism.

In the diversified electronic device, the switch is desired to vary the operation feeling for each function. That is, differentiation of operation feelings is desired. However, in the related art slide switches, the differentiation of the operation feeling is not sufficiently satisfied.

SUMMARY

It is therefore an object of the invention to provide a slide switch capable of vary the operation feeling for each function and satisfying the differentiation of the operation feeling, which are desired in diversified electronic devices.

In order to achieve the above described object, according to the invention, there is provided a slide switch comprising:

a case, defining a chamber;

a slider, disposed in the chamber and being movable between a first position and a second position;

a first contact member, disposed in the chamber and being movable in conjunction with the slider;

a second contact member, disposed in the chamber;

an urging member, disposed in the chamber; and a projection portion, adapted to be fitted with a first recess portion, wherein:

when the slider is located in the first position, the first contact member comes in contact with the second contact member and the projection portion is not fitted with the first recess portion; and when the slider is in the second position, the first contact member is separated from the second contact member, the projection portion is fitted with the first recess portion, and the urging member urges the slider toward the first position.

With this configuration, when the slider is moved from the first position to the second position, the urging member is expanded or contracted in conjunction with the movement of the slider. Then, the urging member urges the slider toward the first position so as to automatically reposition the slider in the first position (i.e. the automatic restoration function). In addition, when the slider is switched from the first position to the second position, the projection portion is fitted with the first recess portion. Then, the click feeling is given to an operator (i.e. the click feeling function). The projection portion and the first recess portion constitute a detent mechanism.

The slider may be movable between the first position and a third position opposite to the second position with respect to the first position.

With this configuration, it is possible to simply provide a slide switch, which has a new operation feeling in which the differentiation of operation feelings is accomplished by combining the automatic restoration function and the click feeling function. It is also possible to easily provide a slide switch, which has a variety of new operation feelings without adding changes to the case, first contact member, the second contact member, and the urging member by adding slight changes to a shape of the slider.

The projection portion may be adapted to be fitted with a second recess portion;

when the slider is located in the third position, the projection portion may be fitted with the second recess portion; and when the slider is located in one of the first position and the second position, the projection portion may not be fitted with the second recess portion.

With this configuration, when the slider is moved from the first position to the third position, the projection portion is fitted with the second recess portion. Then, the click feeling is given to the operator.

The projection portion may be adapted to be fitted with a third recess portion;

when the slider is located in the first position, the projection portion may be fitted with the third recess portion; and when the slider is located in one of the second position and the third position, the projection portion may not be fitted with the third recess portion.

With this configuration, when the slider is moved from one of the second position and the third position to the first position, the projection portion is fitted with the third recess portion. Then, the click feeling is given to the operator.

When the slider is located in the third position, the urging member may urge the slider toward the first position.

With this configuration, when the slider is moved from the first position to the third position, the urging member is expanded or contracted in conjunction with the movement of the slider. Then, the urging member urges the slider toward the first position so as to automatically reposition the slider in the first position.

The second position may be positioned in a forward side of the slide switch.

The third position may be positioned in a backward side of the slide switch.

The second position may be positioned in a backward side of the slide switch.

The third position may be positioned in a forward side of the slide switch.

The projection portion may be integrally formed on the case.

The first recess portion may be formed on the slider.

With this configuration, it is possible to simplify a structure of the slide switch by forming the projection portion for the detent mechanism on the case. It is also possible to simplify the structure of the slide switch by forming the projection portion for the detent mechanism on the slider.

The projection portion may be clicked when the projection portion is fitted with the first recess portion.

According to the invention, there is also provided a slide switch comprising:

a case, defining a chamber;

a slider, disposed in the chamber and being movable between a first position and a second position and between the first position and a third position opposite to the second position with respect to the first position;

a first contact member, disposed in the chamber and being movable in conjunction with the slider;

a second contact member, disposed in the chamber;

an urging member, disposed in the chamber; and a projection portion, adapted to be fitted with a first recess portion, wherein:

the first contact member comes in contact with the second contact member when the slider is located in the first position, and separated from the second contact member when the slider is located in one of the second position and the third position;

the projection portion is fitted with the first recess portion when the slider is located in one of the second position and the third position, and is not fitted with the first recess portion when the slider is located in the first position or the other one of the second position and the third position;

the urging member urges the slider toward the first position when the slider is located in at least one of the second position and the third position.

The projection portion may be adapted to be accommodated in a second recess portion;

the projection portion may be accommodated in the second recess portion when the slider is located in the first position and the third position, and may not be accommodated in the second recess portion when the slider is located in the second position; and the projection portion may be clicked when the slider is moved from the second position to the first position, and may not be clicked when the slider is moved form the third position to the first position.

BRIEF DESCRIPTION OF THE DRAWINGS

The above objects and advantages of the present invention will become more apparent by describing in detail preferred exemplary embodiments thereof with reference to the accompanying drawings, wherein:

FIG. 15 is a table tabulating variations in the slide switch of the invention.

DETAILED DESCRIPTION OF THE EMBODIMENTS

Hereinafter, an embodiment of a slide switch according to the invention will be discussed with reference to the accompanying drawings.

Embodiment 1

Figure 1:
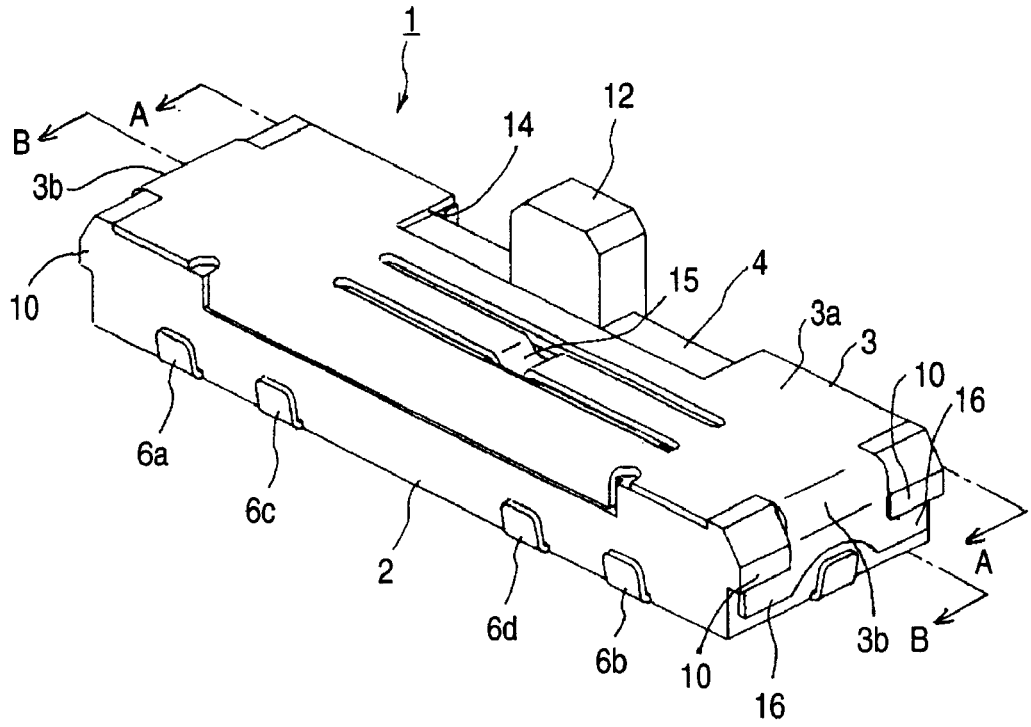
FIG. 1 is a perspective view showing a slide switch according to a first embodiment of the invention.
Figure 2:
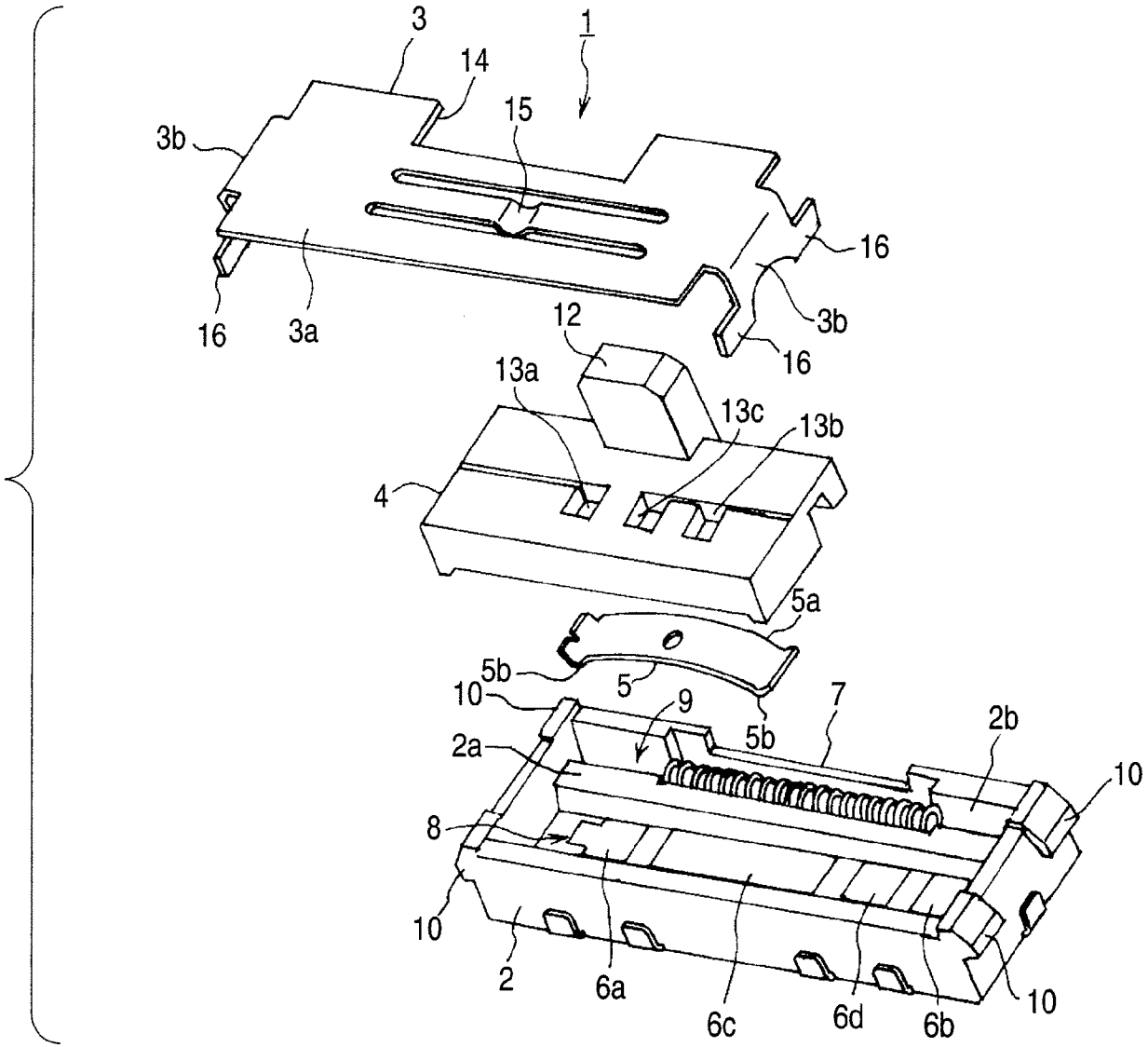
FIG. 2 is an exploded perspective view of the slide switch according to the first embodiment.
Figure 3:
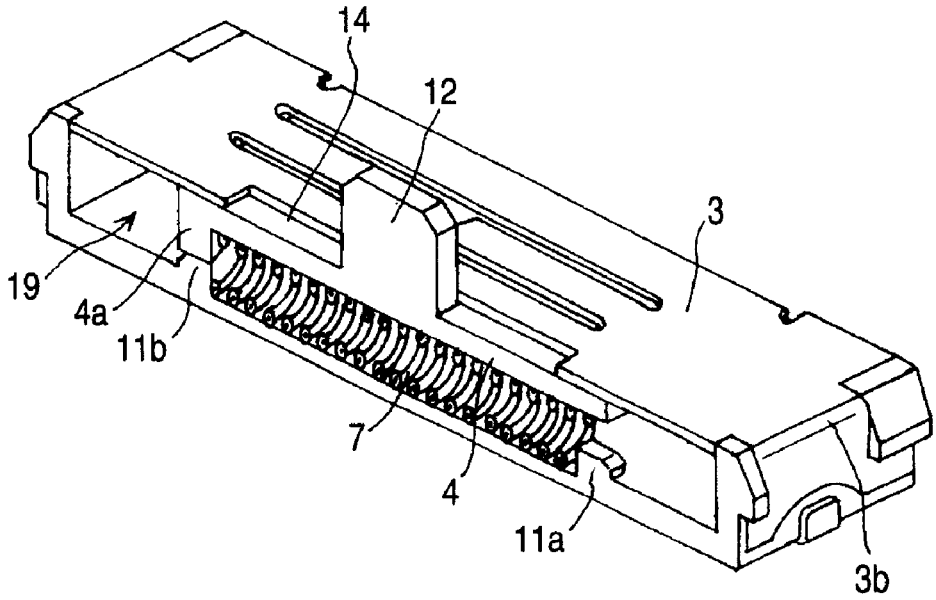
FIG. 3 is a perspective section view taken along line A-A of FIG. 1.
Figure 4:
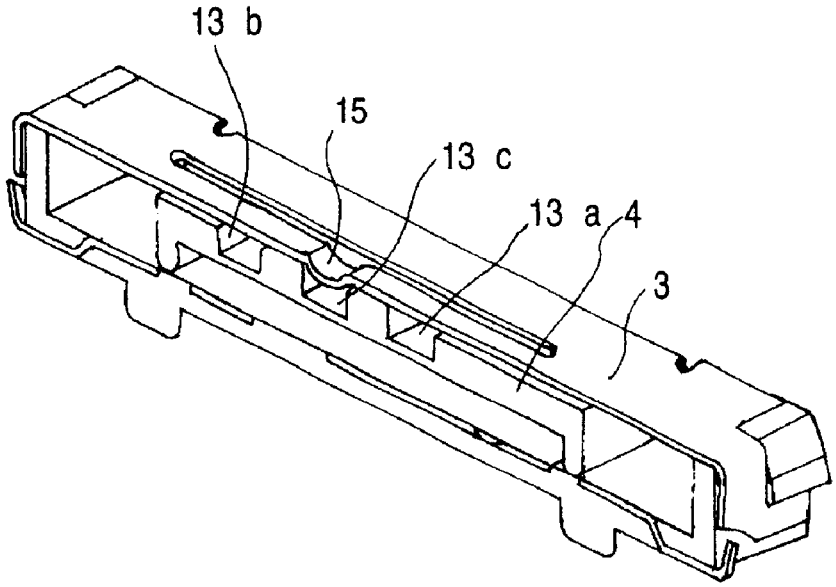
FIG. 4 is a perspective section view taken along line B-B of FIG. 1.

A first embodiment of a slide switch in the invention is described in detail in the following with reference to FIG. 1 to FIG. 4. As shown in FIG. 1 to FIG. 4, a slide switch 1 is constituted of a case body 2, a case cover 3, a slider 4, a contact 5 as a moving contact member, stationary contact members 6*a*, 6*b* and 6*d*, and a common stationary contact member 6*c*, and a coil spring 7. In FIG. 1 and FIG. 2, the left side on the sheet is defined as the forward side of the slide switch, and the right side on the sheet is defined as the backward side of the slide switch. In FIG. 3 and FIG. 4, the right side on the sheet is defined as the forward side of the slide switch, and the left side on the sheet is defined as the backward side of the slide switch.

The case body 2 is made of a synthetic resin and formed into a box shape of which upper face is opened, as shown in FIG. 2. In the inner side of the case body 2, a partition wall 2*a* which is disposed on the substantially center in the left and right direction, which is perpendicular to the forward and backward direction, of the bottom face of the case body 2 and is extended in the forward and backward direction and a inner wall 2*b* of an outer periphery of the case body 2 define a stationary contact member holding recess 8 and a coil spring housing recess 9 each of which extends in the forward and backward direction of the slide switch. A pair of retaining pawls 10 is arranged on each of the forward side and backward side outer faces of the case body 2 in the left and right direction. Here, the height of the partition wall 2*a* from the bottom face is smaller than that of the inner wall 2*b* of the outer periphery of the case body 2.

On the bottom face of the stationary contact member holding recess 8, as shown in FIG. 2, the stationary contact member 6*a*, the common stationary contact member 6*c*, the stationary contact member 6*d* and the stationary contact member 6*b* are insert-molded and aligned in sequence in the forward and backward direction.

As shown in FIG. 3, the coil spring 7 is accommodated and disposed in the coil spring housing recess 9 so as to extend in the forward and backward direction. The coil spring 7 is sandwiched between a front side positioning projection 11*a* and a rear side positioning projection 11*b*. Therefore, when a front side end portion of the coil spring 7 is pushed toward the rear side positioning projection 11*b*, a rear side end portion of the coil spring is positioned on the rear side positioning projection 11*b* and the coil spring 7 is contracted. On the other hand, when the rear side end portion of the coil spring 7 is pushed toward the front side positioning projection 11*a*, the front side end portion of the coil spring 7 is pushed toward the front side positioning projection 11*a*.

As shown in FIG. 2, the slider 4 is made of a synthetic resin material and formed into a longitudinally extending block shape. As shown in FIG. 3, the slider 4 is accommodated in a housing chamber 19 defined by the case body 2 and the case cover 3 so that a bottom face thereof is placed on the partition 2*a*, and is extended over the stationary contact member holding recess 8 and the coil spring housing recess 9 and is movable in the forward and backward direction.

A knob 12 is formed on the upper face of the slider 4 so as to be disposed on one end in the left and right direction, of the upper face and to extend upward from the center in the forward and backward direction. A front side switching position recess 13*a*, a neutral position recess 13*b* and a rear side switching position recess 13*b* are formed on the upper face of the slider 4 so as to be disposed on the other edge of the upper face and to be aligned in sequence in the forward and backward direction as shown in FIGS. 2 and 4.

On the other hand, the contact 5 which corresponds to the stationary contact member holding recess 8 is mounted on the lower face of the slider 4 so as to be movable integrally with the slider 4. As shown in FIG. 3, a front side action portion 4*a* which corresponds to the coil spring housing recess 9 is protruded downward from the rear side end portion on the lower face of the slider 4.

The case cover 3 is press-molded of a metallic sheet material, and having a body portion 3*a* covering the upper face of the case body 2 and defining the housing chamber 19 together with the case body 2, and a pair of front and rear retaining members 3*b* folded downward at a substantially right angle from the right and left sides of the body portion 3*a*. A pair of retaining pawl portions 16 which correspond to the retaining pawls 10 of the case body 2 is formed in each of tip end portions of the retaining members 3*b*.

A notch 14 is formed in the body portion 3*a* of the case cover 3 so as to extend in the forward and backward direction, and is positioned at a position which corresponds to the knob 12 of the slider 4 which is accommodated in the case body 2.

The body portion 3*a* of the case cover is buckled so that a projection 15 is formed on the body portion 3*a* so as to be protruded downward, i.e. toward the slider 4. The projection 15 is positioned at a position corresponding to the front side switching position recess 13*a*, the neutral position recess 13*c* and the rear side switching position recess 13*b* of the slider 4. The projection 15 constitutes a detent mechanism for giving a click feeling to a slide switch operation of the slider together with the front side switching position recess 13*a*, the neutral position recess 13*c* and the rear side switching position recess 13*b* of the slider 4.

The contact 5 is press-molded of a conductive sheet material, and having a body portion 5*a* to be fixed to the bottom face of the slider 4 and moving contacts 5*b* which are respectively formed at the two end portions of that body portion 5*a*. The moving contact portions 5*b* elastically slides on and comes into contact with the stationary contact members 6*a*, 6*b* and 6*d* and the common stationary contact member 6*c* in the stationary contact member holding recess 8.

Next, one example of the assembling procedure of the slide switch 1 is described in the following. First of all, there is prepared the case body 2 which is provided with the stationary contact members 6*a*, 6*b* and 6*d* and the common stationary contact member 6*c* in the stationary contact member holding recess 8 thereof. The coil spring 7 is set in the coil spring housing recess 9 of the case body 2. At this time, the coil spring 7 is interposed between the front side positioning projection 11*a* and the rear side positioning projection 11*b*.

Next, the slider 4 in which the contact 5 is attached to the lower face thereof is prepared, and disposed within the housing chamber so that the lower face of the slider 4 is directed downward.

Subsequently, the case cover 3 is covered on the upper side of the slider 4 with the knob 12 of the slider 4 being projected upward to the outside of the case cover 3 through the notch 14, and the retaining pawl portions 16 of the retaining members 3*a* and 3*b* are individually hooked on the retaining pawls 10 of the case body 2. The assembly is completed when the case cover 3 is fixed in the case body 2.

The actions of the assembled slide switch 1 are described in the following.

As shown in FIG. 4, in this slide switch 1, when the projection 15 of the case cover 3 corresponds to and is fitted with the neutral position recess 13*c* of the slider 4, the slider 4 is located in a home position (or the neutral position). In this situation, and the contact 5 contacts with the common stationary contact member 6*c* and the stationary contact member 6*d*.

In order to move the slider 4 from the neutral position to the front side switching position, the switching operation in which the slider 4 is moved from the neutral position to the front side switching position using the knob 12 is performed. When this operation is performed, the slider 4 starts its movement. When the rear side switching position recess 13*b* is reached at a position corresponding to the projection 15 of the case cover 3, the projection 15 is fitted with the rear side switching position recess 13*b*, whereby the slider 4 is located in the front side switching position, so that the click feeling by the detent mechanism is given to the operator. At this front side switching position, the contact 5 contacts with the common stationary contact member 6*c* and the stationary contact member 6*a*. When the slider 4 is moved from the neutral position to the front side switching position, the front side action portion 4*a* abuts against and is coupled to the rear end portion of the coil spring 7 so as to push the rear end portion of the coil spring 7 toward the front side positioning projection 11*a* and to compress the coil spring. As a result, the slider 4 moves while storing an urging force in the coil spring 7 for repositioning the slider to the neutral position.

In a case where the slider 4 is returned from the front side switching position to the neutral position, the force having operated the knob 12 is released. Then, an automatic restoring operation to move the slider 4 from the front side switching position to the neutral position is performed by the urging force stored in the coil spring 7. When this operation is performed, the slider 4 starts its movement toward the neutral position. When the neutral position recess 13*c* is reached at a position corresponding to the projection 15 of the case cover 3, the projection 15 is again fitted with the neutral position recess 13*c*. Simultaneously with this, the urging force stored in the coil spring 7 disappears. Therefore the slider 4 is kept to the neutral position.

In order to move the slider 4 from the neutral position to the rear side switching position, the switching operation in which the slider 4 is moved from the neutral position to the rear side switching position is performed using the knob 12. In this movement, since the slider 4 is not provided with the action portion for pushing the front end portion of the coil spring 7 toward the rear end positioning projection 11*b*, the coil spring 7 is not compressed. Thus, the slider 4 is moved without storing the urging force in the coil spring 7 for repositioning the slider to the neutral position. When this operation is performed, the slider 4 starts its movement. When the front side switching position recess 13*a* reached at a position corresponding to the projection 15 of the case cover 3, the projection 15 is fitted with the front side switching position recess 13*a* whereby the slider 4 is located in the rear side switching position, so that the click feeling by the detent mechanism is given to the operator. In this switching operation, the urging force for automatically repositioning the slider 4 is not stored in the coil spring 7 so that the position is held even if the operating force to the knob 12 is released. At this rear side switching position, moreover, the contact 5 contacts with the common stationary contact 6*c* and the stationary contact 6*b*.

In a case where the slider 4 is returned from the rear side switching position to the neutral position, the slider 4 is manually moved through the knob 12 from the rear side switching position to the neutral position, because the urging force for repositioning the slider 4 is not stored in the coil spring 7. When this operation is performed, the slider 4 starts its movement. When the neutral position recess 13*c* is reached at a position corresponding to the projection 15 of the case cover 3, the projection 15 is again fitted with the neutral position recess 13*c* so that the slider is located at the neutral position. Thus, the click feeling by the detent mechanism is given to the operator.

Thus, in the Embodiment 1, the slide switch has the automatic restoring function and the click feeling function. When the slider 4 is moved to the individual positions of the neutral position, the front side switching position and the rear side switching position, the click feeling by the detent mechanism can be obtained at the individual moved positions. When the slider 4 is moved from the neutral position to the front side switching position and returned from the front side switching position to the neutral position, moreover, the self-restoration can be achieved by the urging force of the coil spring 7. Thus, the structure of Embodiment 1 can provide the slide switch having the variations.

According to the slide switch 1 of the invention, various slide switches can be easily obtained by partially changing the shape of the slider 4. Moreover, these various slide switches can satisfy the differentiations in the operation feelings, which are desired by the diversified electronic devices. Next, the variations other than Embodiment 1 are described as Embodiments 2 to 6. Here, Embodiment 2 to Embodiment 6 have identical structures excepting a portion of the shape of the slider 4. Thus, Embodiment 2 to Embodiment 6 are described on the portions different from other embodiments while omitting the overlapped description by designating the common structures by the common reference numerals and signs.

Embodiment 2

Figure 5:
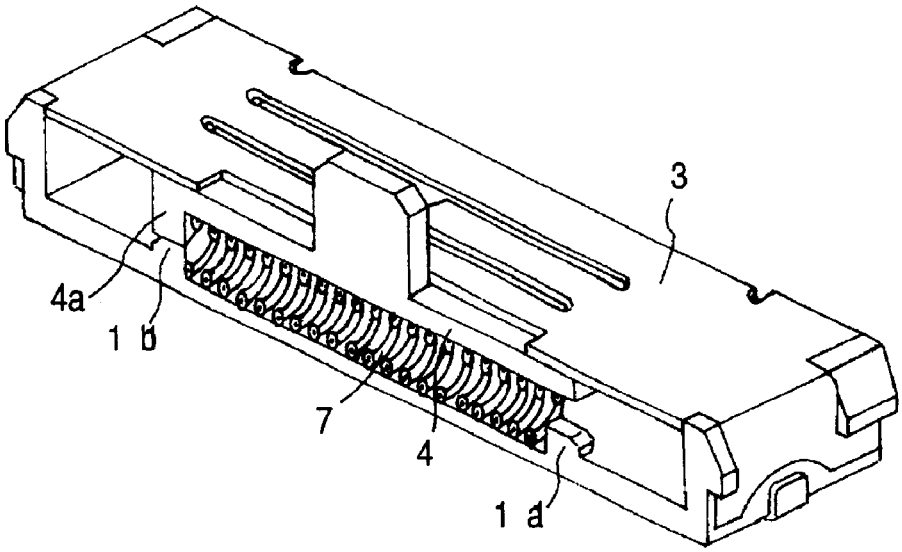
FIG. 5 is a perspective section view showing a slide switch according to a second embodiment of the invention and corresponding to the section of line A-A of FIG. 1.
Figure 6:
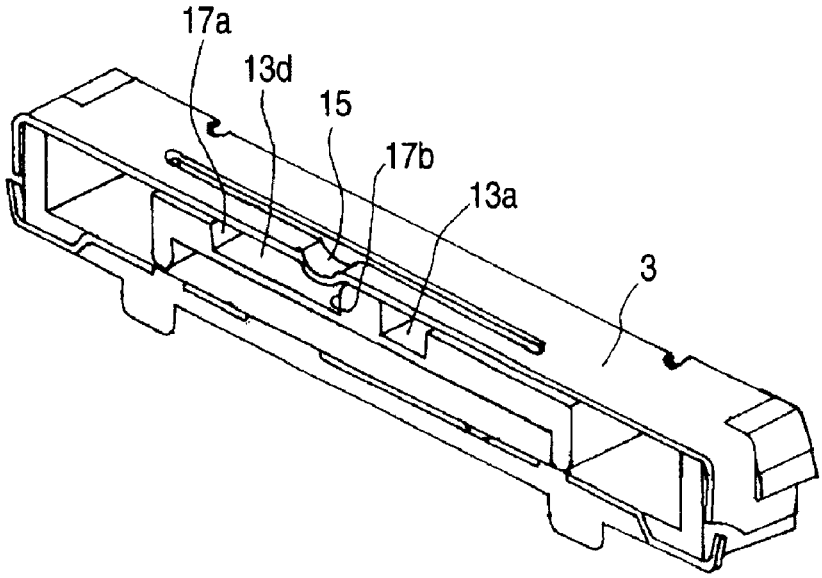
FIG. 6 is a perspective section view showing the slide switch according to the second embodiment of the invention and corresponding to the section of line B-B of FIG. 1.

FIG. 5 and FIG. 6 show Embodiment 2, and correspond to FIG. 3 and FIG. 4 which show Embodiment 1. As shown in FIG. 6, a common recess 13*d* is shaped like a recess combining and communicating the neutral position recess 13*c* and the rear side switching position recess 13*b* which are formed in the upper face of the slider 4 in Embodiment 1 and aligned together with the front side switching position recess 13*a* in the forward and backward direction.

The actions of the slide switch 1 in Embodiment 2 are described in the following.

In this slide switch 1, the home position (or the neutral position) of the slider 4 is defined as a position where the projection 15 of the case cover 3 abuts against a front side inner wall 17*b* of the common recess 13*d*, as shown in FIG. 6.

In order to move the slider 4 from the neutral position to the front side switching position, the switching operation in which the slider 4 is moved from the neutral position to the front side switching position using the knob 12 is performed. When this operation is performed, the slider 4 starts to move while compressing the coil spring 7 to store the self-restoring urging force in the coil spring 7. When a rear side inner wall 17*a* of the common recess 13*d* abuts against the projection 15 of the case cover 3, the slider 4 is switched to the front side switching position so that it cannot move to forward any more.

In a case where the slider 4 is returned from the front side switching position to the neutral position, the operating force applied to the knob 12 is released. Then, the slider 4 is moved toward the neutral position by the self-restoring urging force stored in the coil spring 7. When the slider 4 is returned to the neutral position, the front side inner wall 17*b* of the common recess 13*d* abuts against the projection 15. Simultaneously, the urging force of the coil spring 7 disappears, so that the projection 15 is held in abutment against the front side inner wall 17*b*.

When the slider 4 is moved from the neutral position to the rear side switching position, the slider 4 is moved through the knob 12 from the neutral position to the rear side switching position. In this movement, since the slider 4 is not provided with the action portion for pushing the rear end portion of the coil spring 7 toward the front end positioning projection 11*b*, the coil spring 7 is not compressed. Thus, the slider 4 is moved without storing the self-restoring urging force in the coil spring 7 for repositioning the slider 4 to the neutral position. When the front side switching position recess 13*a* reached at a position corresponding to the projection 15 of the case cover 3, the projection 15 is fitted with the front side switching position recess 13*a* so that the slider 4 is located at the rear side switching position. Thus, the click feeling by the detent mechanism is given to the operator.

In a case where the slider 4 is returned from the rear side switching position to the neutral position, the slider 4 is manually moved through the knob 12 from the rear side switching position to the neutral position, because the self-restoring urging force for repositioning the slider 4 is not stored in the coil spring 7. When the slider 4 is returned to the neutral position, the projection 15 is again dropped into the common recess 13*d*. Thus, the click feeling by the detent mechanism is given to the operator. Simultaneously, the urging force of the coil spring 7 disappears, so that the projection 15 is held in a state where the projection 15 abuts against the front side inner wall 17*b*.

Thus, in Embodiment 2, the slide switch has the automatic restoring function and the click feeling function. When the slider 4 is moved to the rear side switching position, the click feeling by the detent mechanism can be obtained at the moved position. When the slider 4 is moved from the neutral position to the front side switching position and returned from the front side switching position to the neutral position, the self-restoration can be achieved by the urging force of the coil spring 7. Thus, the structure of Embodiment 2 can provide the slide switch having the variations.

Embodiment 3

Figure 7:
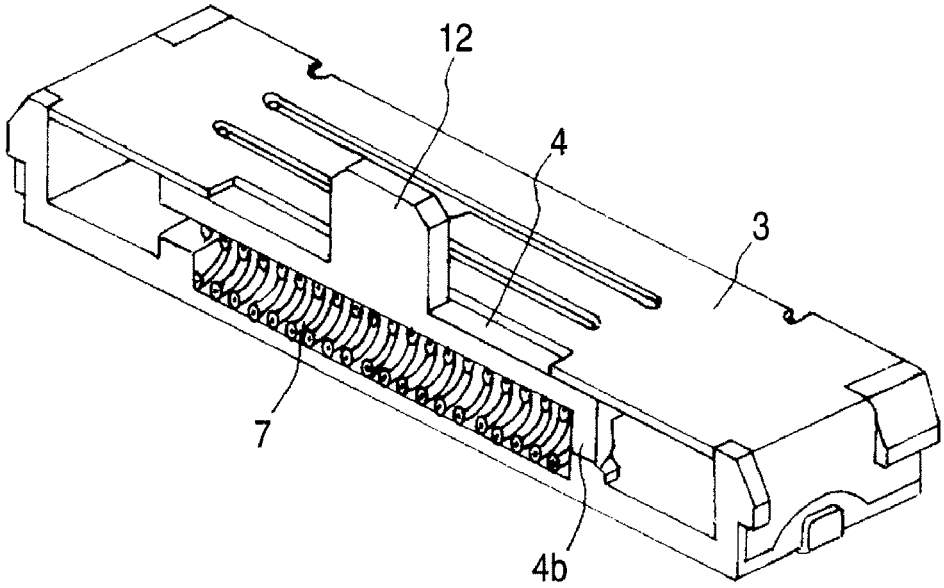
FIG. 7 is a perspective section view showing a slide switch according to a third embodiment of the invention and corresponding to the section of line A-A of FIG. 1.
Figure 8:
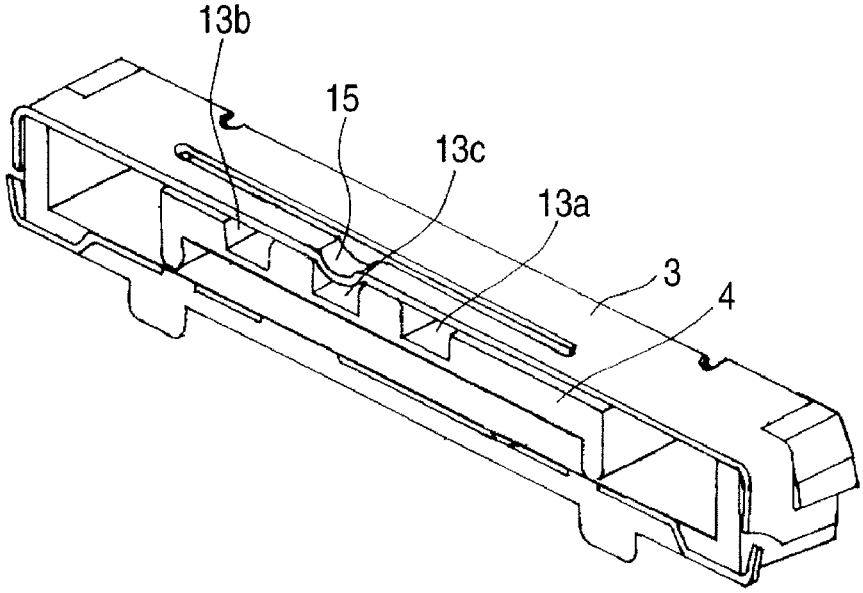
FIG. 8 is a perspective section view showing the slide switch according to the third embodiment of the invention and corresponding to the section of line B-B of FIG. 1.

FIG. 7 and FIG. 8 show Embodiment 3, and correspond to FIG. 3 and FIG. 4 of Embodiment 1. In Embodiment 3, the structure of slider 4 in Embodiment 1 is modified such that the front side action portion 4*a* is eliminated and alternatively, a rear side action portion 4*b* is provided on the lower face of the slider 4, as shown in FIG. 7.

The actions of the slide switch 1 in Embodiment 3 are described in the following.

In this slide switch 1, the neutral position of the slider 4 is defined as a position where the projection 15 of the case body 3 is fitted with the neutral position recess 13*c* of the slider 4, as shown in FIG. 8.

In order to move the slider 4 from the neutral position to the front side switching position, the switching operation in which the slider 4 is moved from the neutral position to the front side switching position using the knob 12 is performed. In this movement to the front side, since the slider 4 is not provided with the action portion for pushing the rear end portion of the coil spring 7 toward the front end positioning projection 11*a*, the coil spring 7 is not compressed. Thus, the slider 4 is moved without storing the restoring urging force in the coil spring 7 for repositioning the slider 4 to the neutral position. When the rear side switching position recess 13*b* is reached at a position corresponding to the projection 15 of the case cover 3, the projection 15 is fitted with the rear side switching position recess 13*b* so that the slider 4 is located at the front side switching position. Thus, the click feeling by the detent mechanism is given to the operator. In this switching operation, since the automatic restoring force by the coil spring 7 is not generated, the position of the slider 4 is held to the front side switching position even if the operating force applied to the knob 12 is released.

In a case where the slider 4 is to be returned from the front side switching position to the neutral position, the slider 4 is manually moved through the knob 12 from the front side switching position to the neutral position, because the self-restoring urging force for repositioning the slider 4 is not stored in the coil spring 7. When the neutral position recess 13*c* of the slider 4 is reached at a position corresponding to the projection 15 of the case cover 3, the projection 15 is again fitted with the neutral position recess 13*c* so that it is arranged at the neutral position. Thus, the click feeling by the detent mechanism is given to the operator.

In order to move the slider 4 from the neutral position to the rear side switching position, the slider 4 is moved through the knob 12 from the neutral position to the rear side switching position. When the switching operation to move the slider 4 from the neutral position to the rear side switching position is performed, the slider 4 starts its movement while compressing the coil spring 7 and storing the self-restoring urging force in the coil spring 7. When the front side switching position recess 13*a* is reached at a position corresponding to the projection 15 of the case cover 3, the projection 15 fitted into the front side switching position recess 13*a* so that the slider 4 is disposed at the rear side switching position. Thus, the click feeling by the detent mechanism is given to the operator.

In a case where the slider 4 is returned from the rear side switching position to the neutral position, the operating force applied to the knob 12 is removed. Then, the slider 4 is moved from the rear side switching position to the neutral position is performed by the urging force stored in the coil spring 7. When the neutral position recess 13*c* is reached at a position corresponding to the projection 15 of the case cover 3, the projection 15 is again fitted with the neutral position recess 13*c*. Simultaneously, the urging force of the coil spring 7 disappears so that the slider 4 is arranged at and held in the neutral position.

Thus, in Embodiment 3, the slide switch has the automatic restoring function and the click feeling function. When the slider 4 is moved to the individual positions of the neutral position, the front side switching position and the rear side switching position, the click feeling by the detent mechanism can be obtained. When the slider 4 is moved from the neutral position to the rear side switching position and returned from the rear side switching position to the neutral position, the self-restoration can be achieved by the urging force of the coil spring 7. Thus, the structure of Embodiment 3 can provide the slide switch having the variations.

Embodiment 4

Figure 9:
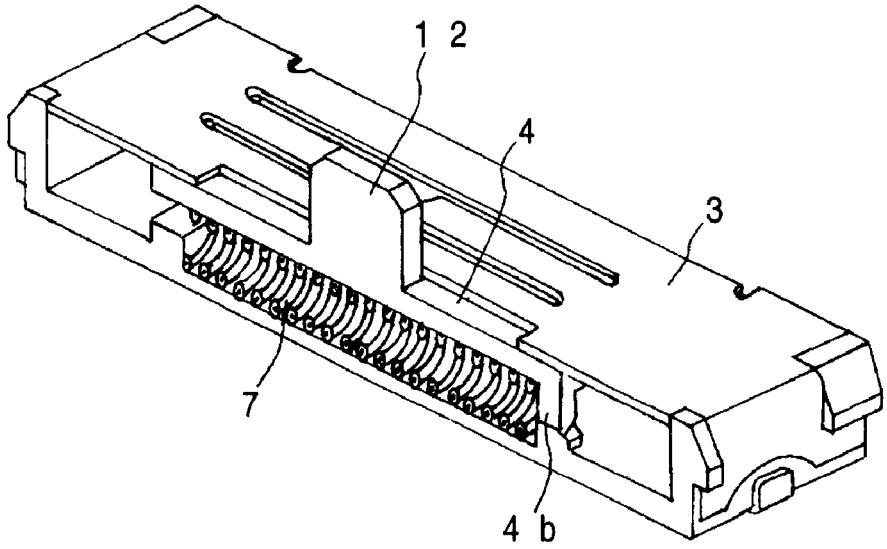
FIG. 9 is a perspective section view showing a slide switch according to a fourth embodiment of the invention and corresponding to the section of line A-A of FIG. 1.
Figure 10:
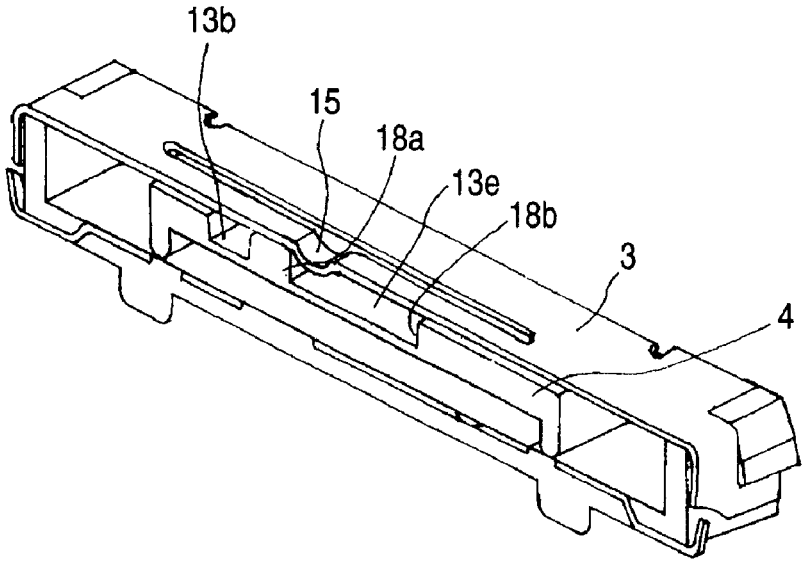
FIG. 10 is a perspective section view showing the slide switch according to the fourth embodiment of the invention and corresponding to the section of line B-B of FIG. 1.

FIG. 9 and FIG. 10 show Embodiment 4, and correspond to FIG. 3 and FIG. 4 which show Embodiment 1. As shown in FIG. 10, a common recess 13*e* is shaped like a recess combining and communicating the neutral position recess 13*c* and the front side switching position recess 13*a* which are formed in the upper face of the slider 4 in Embodiment 3 and aligned together with the rear side switching position recess 13*b* in the forward and backward direction.

The actions of the slide switch 1 in Embodiment 4 are described in the following.

In this slide switch 1, the home position (or the neutral position) of the slider 4 is defined as a position where the projection 15 of the case cover 3 abuts against a rear side inner wall 18*a* of the common recess 13*e*, as shown in FIG. 10.

In order to move slider 4 from the neutral position to the front side switching position, the slider 4 is moved through the knob 12 from the neutral position to the front side switching position. In this movement to the front side, since the slider 4 is not provided with the action portion for pushing the rear end portion of the coil spring 7 toward the front end positioning projection 11*a*, the coil spring 7 is not compressed. Thus, the slider 4 is moved without storing the self-restoring urging force in the coil spring 7 for repositioning the slider 4 to the neutral position. When the rear side switching position recess 13*b* is reached at a position corresponding to the projection 15 of the case cover 3, the projection 15 fitted with the rear side switching position recess 13*b* so that the slider 4 is located at the front side switching position. Thus, the click feeling by the detent mechanism is given to the operator.

In a case where the slider 4 is returned from the front side switching position to the neutral position, the slider 4 is manually moved through the knob 12 from the front side switching position to the neutral position, because the self-restoring force for repositioning the slider 4 is not stored in the coil spring 7. When the slider 4 is returned to the neutral position, the projection 15 is again dropped into the common recess 13*e*. Thus, the click feeling by the detent mechanism is given to the operator. Simultaneously, the urging force of the coil spring 7 disappears, so that the projection 15 is held in a state where the projection 15 abuts against the rear side inner wall 18*a*.

In order to move the slider 4 from the neutral position to the rear side switching position, the switching operation from the neutral position to the rear side switching position is performed through the knob 12 to the slider 4. Then, the slider 4 starts to move while compressing the coil spring 7 to store the self-restoring urging force in the coil spring 7. When a front side inner wall 18*b* of the common recess 13*e* abuts against the projection 15 of the case cover 3, the slider 4 is switched to the rear side switching position so that it cannot move to backward any more.

In a case where the slider 4 is returned from the rear side switching position to the neutral position, the operating force applied to the knob 12 is released. Then, the slider 4 is moved from the rear side switching position to the neutral position by the urging force stored in the coil spring 7. When the slider 4 is returned to the neutral position, the rear side inner wall 18*a* of the common recess 13*d* abuts against the projection 15.

Simultaneously, the urging force of the coil spring 7 disappears, so that the projection 15 is held in abutment against the front side inner wall 18*a*.

Thus, in Embodiment 4, the slide switch has the automatic restoring function and the click feeling function. When the slider 4 is moved to the front side switching position, the click feeling by the detent mechanism can be obtained. When the slider 4 is moved from the neutral position to the rear side switching position and returned from the rear side switching position to the neutral position, moreover, the self-restoration can be achieved by the urging force of the coil spring 7. Thus, the structure of Embodiment 4 can provide the slide switch having the variations.

Embodiment 5

Figure 11:
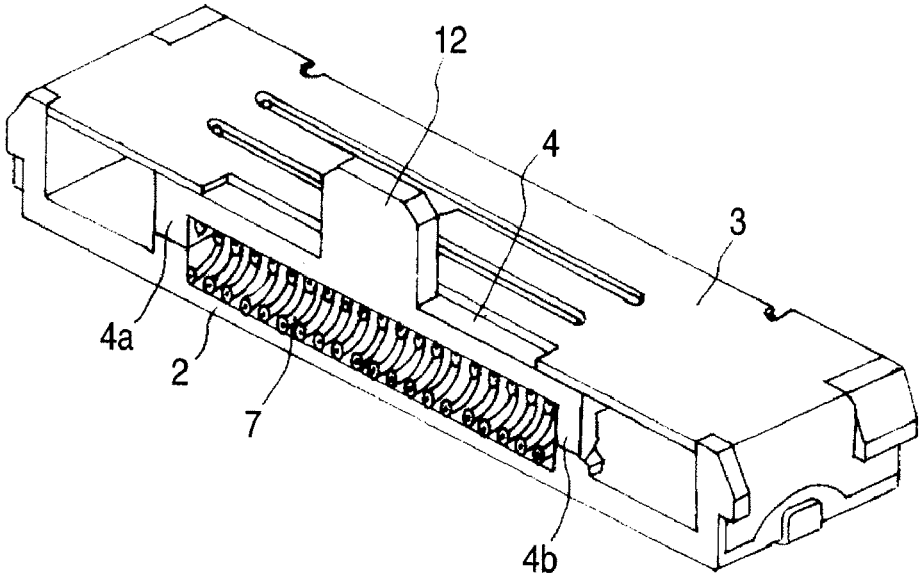
FIG. 11 is a perspective section view showing a slide switch according to a fifth embodiment of the invention and corresponding to the section of line A-A of FIG. 1.
Figure 12:
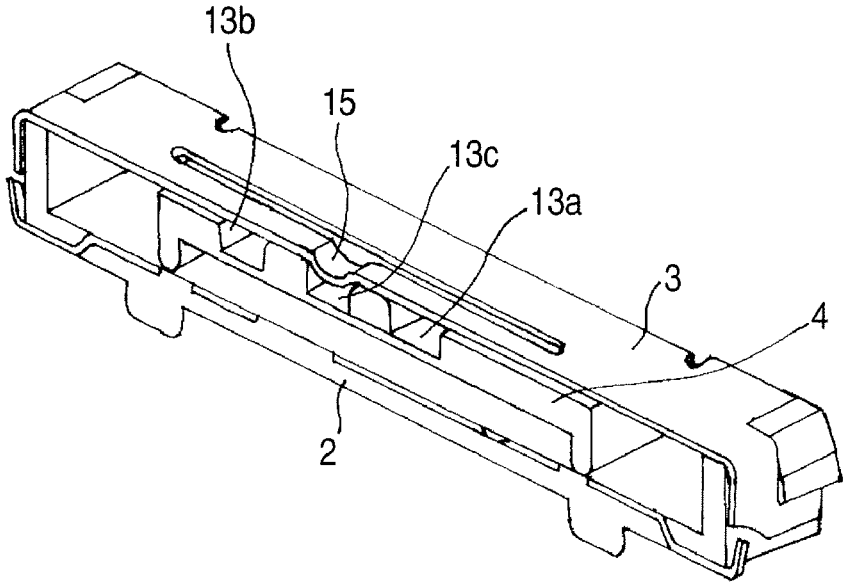
FIG. 12 is a perspective section view showing the slide switch according to the fifth embodiment of the invention and corresponding to the section of line B-B of FIG. 1.

FIG. 11 and FIG. 12 show Embodiment 5, and correspond to FIG. 3 and FIG. 4 of Embodiment 1. In Embodiment 5, the structure of slider 4 in Embodiment 1 is modified such that both the front side action portion 4*a* and the rear side action portion 4*b* are provided on the lower face of the slider 4, as shown in FIG. 11.

In Embodiment 5, the slide switch has the automatic restoring function and the click feeling function. When the slider 4 is moved to the individual positions of the front side switching position and the rear side switching position, the click feeling by the detent mechanism can be obtained. When the slider 4 is moved from the neutral position to the front side switching position and returned from the front side switching position to the neutral position, and is moved from the neutral position to the rear side switching position and returned from the rear side switching position to the neutral position, moreover, the self-restoration can be achieved by the urging force of the coil spring 7. Thus, the structure of Embodiment 5 can provide the slide switch having the variations.

Embodiment 6

Figure 13:
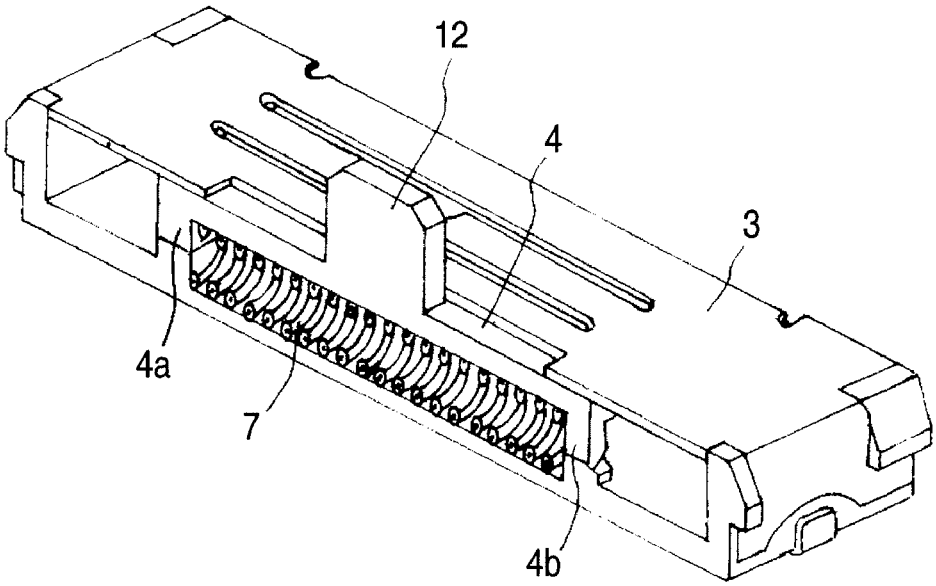
FIG. 13 is a perspective section view showing a slide switch according to a sixth embodiment of the invention and corresponding to the section of line A-A of FIG. 1.
Figure 14:
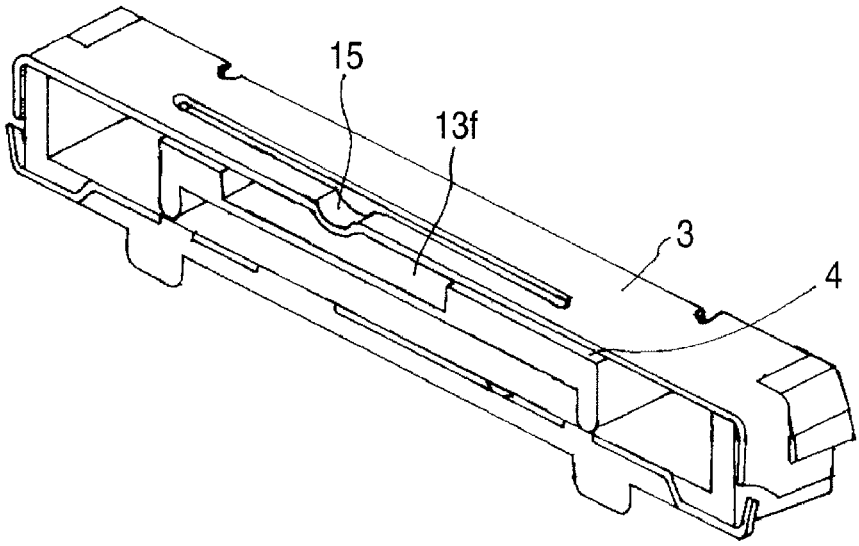
FIG. 14 is a perspective section view showing the slide switch according to the sixth embodiment of the invention and corresponding to the section of line B-B of FIG. 1.

FIG. 13 and FIG. 14 show Embodiment 6, and correspond to FIG. 3 and FIG. 4 of Embodiment 1. As shown in FIG. 14, a common recess 13*f* is shaped like a recess combining and communicating the front side switching position recess 13*a*, the neutral position recess 13*c* and the rear side switching position recess 13*b* which are formed in the upper face of the slider 4 in Embodiment 5 and is formed on the upper face of the slider 4.

In Embodiment 6, the slide switch has the automatic restoring function. When the slider 4 is moved from the neutral position to the front side switching position and returned from the front side switching position to the neutral position, and is moved from the neutral position to the rear side switching position and returned from the rear side switching position to the neutral position, moreover, the self-restoration can be achieved by the urging force of the coil spring 7. Thus, the structure of Embodiment 6 can provide the slide switch having the variations.

FIG. 15 is a table indicating the variations in the structures of Embodiments 1 to 6. In Table, the symbols "O" indicate "Function", and the blanks indicate "No Function". It is also apparent from FIG. 15 that the invention is enabled to provide slide switches having at least six variations by changing only the structure of the slider.

Here, the invention can be modified in various manners so long as it deviates from its scope, and covers those modifications.

What is claimed is:

1. A slide switch comprising:

a case, defining a chamber;

a slider, disposed in the chamber and being movable between a first position and a second position;

a first contact member, disposed in the chamber and being movable in conjunction with the slider;

a second contact member, disposed in the chamber;

an urging member, disposed in the chamber; and a projection portion, adapted to be fitted with a first recess portion, wherein:

when the slider is located in the first position, the first contact member comes in contact with the second contact member and the projection portion is not fitted with the first recess portion; and when the slider is in the second position, the first contact member is separated from the second contact member, the projection portion is fitted with the first recess portion, and the urging member urges the slider toward the first position.

2. The slide switch as set forth in claim 1, wherein the slider is movable between the first position and a third position opposite to the second position with respect to the first position.

3. The slide switch as set forth in claim 2, wherein:

the projection portion is adapted to be fitted with a second recess portion;

when the slider is located in the third position, the projection portion is fitted with the second recess portion; and when the slider is located in one of the first position and the second position, the projection portion is not fitted with the second recess portion.

4. The slide switch as set forth in claim 3, wherein:

the projection portion is adapted to be fitted with a third recess portion;

when the slider is located in the first position, the projection portion is fitted with the third recess portion; and when the slider is located in one of the second position and the third position, the projection portion is not fitted with the third recess portion.

5. The slide switch as set forth in claim 2, wherein when the slider is located in the third position, the urging member urges the slider toward the first position.

6. The slide switch as set forth in claim 2, wherein:

the second position is positioned in a forward side of the slide switch; and the third position is positioned in a backward side of the slide switch.

7. The slide switch as set forth in claim 2, wherein:

the second position is positioned in a backward side of the slide switch; and the third position is positioned in a forward side of the slide switch.

8. The slide switch as set forth in claim 1, wherein the projection portion is integrally formed on the case.

9. The slide switch as set forth in claim 1, wherein the first recess portion is formed on the slider.

10. The slide switch as set forth in claim 1, wherein the urging member is a coil spring.

11. The slide switch as set forth in claim 1, wherein the projection portion is clicked when the projection portion is fitted with the first recess portion.

12. A slide switch comprising:

a case, defining a chamber;

a slider, disposed in the chamber and being movable between a first position and a second position and between the first position and a third position opposite to the second position with respect to the first position;

a first contact member, disposed in the chamber and being movable in conjunction with the slider;

a second contact member, disposed in the chamber;

an urging member, disposed in the chamber; and a projection portion, adapted to be fitted with a first recess portion, wherein:

the first contact member comes in contact with the second contact member when the slider is located in the first position, and separated from the second contact member when the slider is located in one of the second position and the third position;

the projection portion is fitted with the first recess portion when the slider is located in one of the second position and the third position, and is not fitted with the first recess portion when the slider is located in the first position or the other one of the second position and the third position;

the urging member urges the slider toward the first position when the slider is located in at least one of the second position and the third position.

13. The slide switch as set forth in claim 12, wherein:

the projection portion is adapted to be accommodated in a second recess portion;

the projection portion is accommodated in the second recess portion when the slider is located in the first position and the third position, and is not accommodated in the second recess portion when the slider is located in the second position; and the projection portion is clicked when the slider is moved from the second position to the first position, and is not clicked when the slider is moved form the third position to the first position.

* * * * *